United States Patent [19]

Anderson

[11] 4,207,623

[45] Jun. 10, 1980

[54] ACOUSTIC MINE MECHANISM

[75] Inventor: Lloyd D. Anderson, Takoma Park, Md.

[73] Assignee: The United States of America as represented by the Secretary of the Navy, Washington, D.C.

[21] Appl. No.: 87,001

[22] Filed: Feb. 8, 1955

[51] Int. Cl.[2] ..... F42B 22/04; H04B 11/00

[52] U.S. Cl. ..... 367/133; 102/18 R; 367/136

[58] Field of Search ..... 367/133, 135, 136; 102/18 R

[56] References Cited

U.S. PATENT DOCUMENTS 3,012,503 12/1961 Brown et al. ..... 367/133 X

*Primary Examiner*—Richard A. Farley

*Attorney, Agent, or Firm*—R. S. Sciascia; A. L. Branning

EXEMPLARY CLAIM

1. A system for providing an improved triggering function for firing of a mine from the acoustic signature of a ship passing thereover or in the vicinity thereto comprising means for detecting the envelope of a portion of the audio signature spectrum of the ship, means for deriving a signal corresponding to the logarithm of said detected envelope signal, means responsive to said logarithm signal for providing a signal represntative of the first time derivative thereof, means for subsequently obtaining a signal simulating the second time derivative of said logarithmic signal, means for inverting the phase of said second time derivative signal, means for providing a multiplication of said first and second time derivative signals, and means responsive to said multiplied signals for actuation of a mine detonating circuit.

9 Claims, 7 Drawing Figures

ACOUSTIC MINE MECHANISM

The invention described herein may be manufactured and used by or for the Government of the United States of America for governmental purposes without the payment of any royalties thereon or therefor.

This invention relates to an acoustic discriminator system for aircraft laid ground mines and an improved method of triggering a mine firing circuit. More particularly, the invention is concerned with providing sharper athwartship amplitude fall-off curves or characteristics for mine firing circuit actuation in which the firing peak is advanced with respect to the peak of the second derivative of the logarithm of the input signature. This invention additionally provides depth compensation for different depths of submergence of the mine while substantially preventing early and late misfirings of the mine mechanism such as are inherent in prior systems utilizing sensitivity to the audio amplitude fall-off characteristics of the signals received abeam from the ship and which signal curves are normally too flat to provide a reliable firing or triggering function for mine actuation.

It is a purpose of the invention to eliminate the loudness of the ship's acoustic signal as a factor governing the triggering of the mine mechanism.

More specifically the invention utilizes a particular predetermined frequency band of the sound spectrum of a ship's audio signature and utilizes the product of the first and of the second derivative of the logarithm of the acoustic pressure signal with respect to time as a triggering function for mine firing.

Certain disadvantages are inherent in the prior mine triggering methods, which disadvantages include a flatter athwartship amplitude fall-off curve than is desirable for reliable operation. This unfavorable situation introduces a great number of early and late misfirings of the mine. The prior mechanisms based on the utilization of the rectified averaged amplitudes of the pressure signal and the first derivative with respect to time or the first and second time derivatives of the rectified and averged amplitude of the received pressure signal have patterns which are not independent of the loudness of the ship. It is a feature of the instant invention to provide a triggering function for mine firing which is essentially independent of the ship's loudness constant and which results in a greater adaptability and better control of the firing pattern.

While the instant invention is hereinafter described with respect to an embodiment which utilizes electronic circuitry for obtaining a triggering function based on the foregoing relationships it is to be understood that it is within the province of one skilled in the art to utilize mechanical or hydraulic systems or combinations of circuitry to provide one or all of the intermediate functional relationships for obtaining the desired triggering function and without departing from the scope of the instant invention.

In a generalized form of the instant invention the sound signals picked up by the acoustic transducers are passed through suitable amplifying stages as required to provide necessary gain for the succeeding plurality of operations to which the detected signal is subjected in order to provide the desired triggering function. These functions generally include apparatus or circuits for providing; a band pass filter arrangement for attenuating certain low frequency and high frequency components of the input signal, a second detector stage for subjecting the signal to rectification to detect the envelope of the ship's audible signature, passing the signal through a stage having a logarithmic transfer characteristic for obtaining the logarithm of the signal envelope, thereafter subjecting the output of this stage which provides the logarithm of the signal to a smoothing filter prior to the amplifying of this output, as required, to provide a signal of suitable level for multiplication with a phase inverted signal representing the second derivative of the signal with respect to time. The sequence further includes subjecting a portion of the signal output at the last mentioned amplification stage to a differentiating network for the taking of the second derivative of the logarithm of the signal with respect to time, thereafter inverting and amplifying this portion of the signal in an additional amplifying stage in a manner for multiplying in an output stage of the system.

This output stage may incorporate a sensitive plate current type relay for application of the triggering function output to the mine mixer for utilization.

It is a feature of this invention to provide an improved triggering function characteristic for actuation of a mine firing circuit from the audible signature of a ship passing thereover which function provides a triggering signal which is independent of the amplitude of the ship emitted sound.

One object of this invention resides in providing an improved method of triggering a mine firing circuit by utilizing the product of the first and second derivatives of the logarithm with respect to time of the ship's acoustic signature.

Another object of this invention resides in the provision of a new and novel combination of electronic circuitry for successively detecting a ship's underwater audible signature, obtaining the envelope of the ship's acoustic signature, obtaining a signal equivalent to the taking of the logarithm thereof, obtaining a signal representative of the first differential of said logarithmic signal with respect to time, thereafter obtaining a signal characteristic of the second derivative of said logarithmic signal with respect to time and obtaining an output signal simulating the product of said first derivative signal and said second derivative signal.

Another object resides in the provision of an improved system for firing a mine from a ship's audible signature which substantially overcomes all the foregoing difficulties of systems heretofore or now in general use.

Another object of the invention resides in the provision of a system for detecting the audible signature of a ship passing over a mine which provides a triggering function having the advantage over prior systems of reliably advancing the firing of the mine to a substantially shorter time than systems heretofore or now in use of a character which require the passage of a substantial portion of the ship over the detecting device.

Other objects and many of the attendant advantages of this invention will be readily appreciated as the same becomes better understood by reference to the following detailed description when considered in connection with the accompanying drawings wherein.

Figure 4:
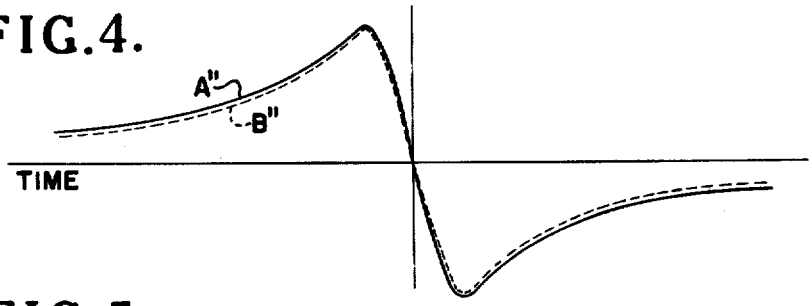
FIG. 4 is a curve showing the characteristics of the first differential of the logarithm signals with respect to time of FIG. 2 and showing how the system becomes insensitive to amplitude variations of the audio signal.
Figure 5:
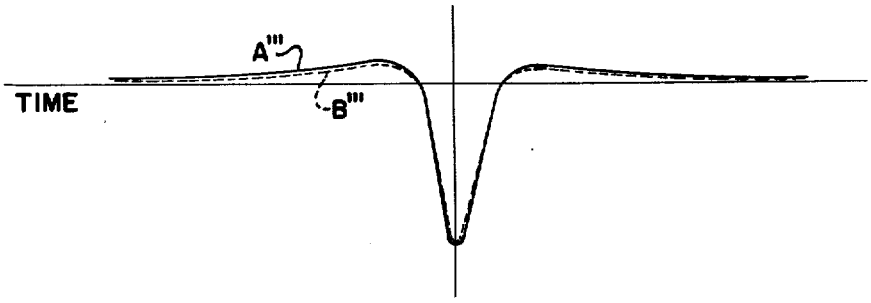
FIG. 5 is a showing of the characteristic curve of the second derivative with respect to time of the logarithmic signal of FIG. 3.
Figure 6:
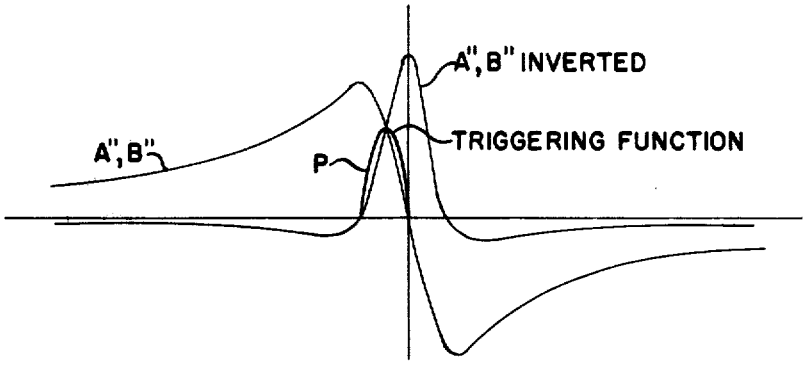
Figure 7:
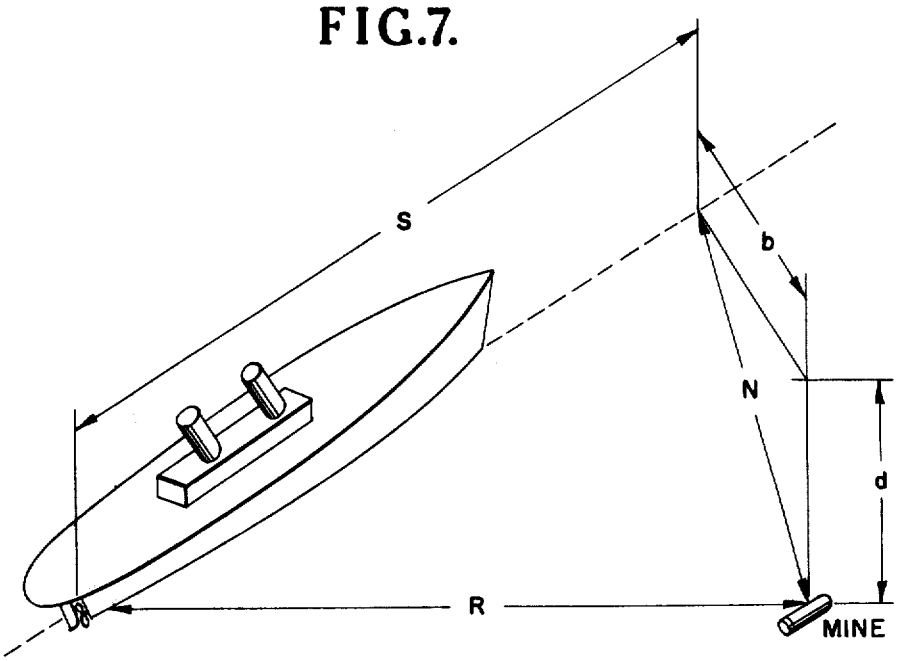

FIG. 6 is a group of curves showing the curve of FIG. 4, the inverted curve of FIG. 5, and a curve representing the product of these two signals of FIGS. 4 and 5, thereby illustrating how the firing time of the mine is advanced by the multiplication of the first and second differential signals; and FIG. 7 is a diagrammatic representation of the geometric relationships of interest between a mine and a ship passing in the vicinity thereto.

Figure 1:
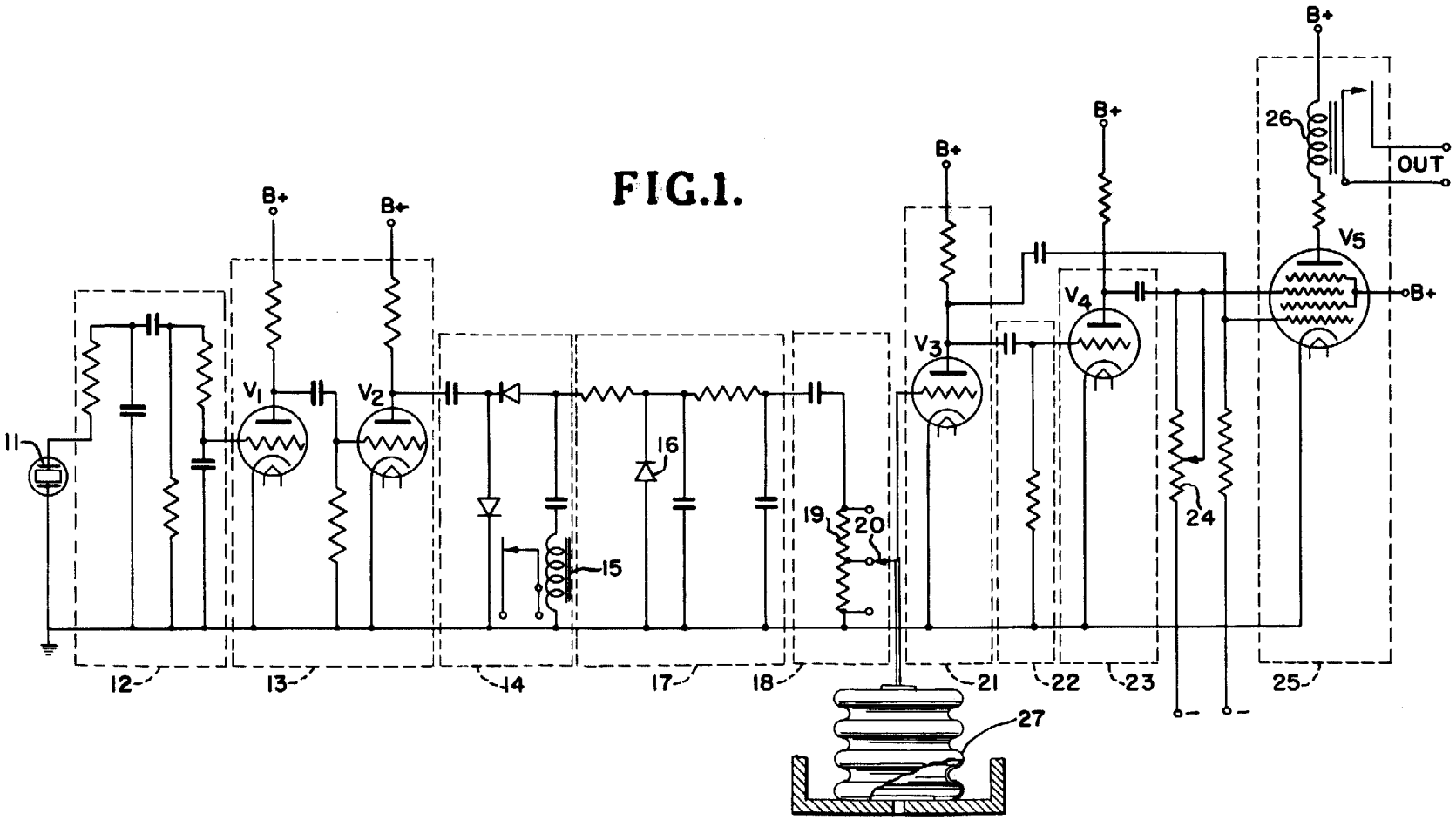
FIG. 1 is a schematic diagram of an electronic circuit of a character for carrying out the method of the invention and is directed to a preferred embodiment of the instant invention.

Referring now to FIG. 1 there is shown a simplified circuit diagram of an acoustic discriminator comprising one embodiment of the instant invention. The circuit consists essentially of the following successively arranged elemental circuits shown in the dotted outline blocks in which a signal transducer such as shown at 11 as a crystal microphone is connected to the input of an electronic amplifier 13 after passing through a bandpass filter network indicated by the block 12. The bandpass filter comprises resistive and capacitative elements connected in a configuration providing both a low frequency attenuation network and a high frequency attenuation network with the components thereof selected in a well-known manner to pass a desired portion of the frequency spectrum of the underwater audio signals produced by a ship passing over a mine or in the immediate vicinity thereto.

The amplifier section 13 is shown to comprise two conventional triode tube resistance-capacitive coupled stages $V_1$ and $V_2$ connected in cascade. The output at the plate of the second stage $V_2$ is rectified by the voltage doubler circuit 14 which, advantageously, may employ barrier type rectifiers. If desired, a voltage sensitive relay 15 may be incorporated in this stage for operation by a high rate of change of this voltage for providing anticountermine protection and temporary disablement of the mine firing circuits. Signals having high rates of change in voltage effect closure of relay contacts which disables the output circuit of the mine not shown.

The voltage appearing at the output of the voltage divider circuit is then applied to a network utilizing a barrier type rectifier 16 having a resistance variation such that the voltage developed across this rectifier or semiconductor is a logarithmic function of the current therethrough. Block 17 shows this logarithmic rectifier circuit in combination with a smoothing filter which is utilized to reduce undersirable effects of the erratic variations in the ship's acoustic output.

The subsequent stage of this system at block 18 comprises means for obtaining the first derivative of the logarithmic signal characteristics by a simple resistance-capacitance network as shown. The values of the time constant are so chosen that a sufficiently good derivative is obtained without introducing excessive attenuation of the signal.

Since these two requirements conflict, the final design values chosen necessarily represent a compromise, however it has been determined from simulation studies that decreasing the time constant to extremely low value does not significantly improve the performance characteristics.

The signals from this differential network 18 appearing across the stepped attenuator 19 are amplified by the subsequent triode amplifying stage $V_3$ shown in block 21. The gain of this stage is determined by the position of the moving contact 20 of the stepped attenuator 19 and for a purpose as will hereinafter become apparent. The amplifier output of tube stage 21 is utilized by being applied through two separate paths, to a subsequent stage $V_5$, the signal of one path is resistance-capacitance coupled to the first grid of the pentagrid multiplier tube $V_5$ of block 25. The signal from $V_3$ for the second output path is passed through a second resistance capacitance differentiating network 22 to the grid of the amplifying and inverting stage $V_4$ in block 23. The output of amplifying stage 23 is applied to the second signal grid of the pentagrid multiplier stage 25 to additionally control the conduction of the tube in a manner whereby the current flow through plate circuit relay 26 corresponds to the desired triggering function. This current flow represents the product of the first time differential of the logarithm of the acoustic signal envelope and the second time derivative of the logarithm of this same signal envelope.

It is deemed apparent from the foregoing that amplified voltages corresponding to the first and second time derivatives of the logarithm of the ship's signature are available at the plates of the tubes $V_3$ and $V_4$ respectively with the output of $V_4$ inverted in phase with respect to the signal from tube $V_3$. It will now be apparent from a consideration of the curve of FIG. 4 that the second time derivative signal must be positive for usage of this signal. This is accomplished by passing the signal through the additional amplification stage 23 of tube $V_4$. In order to utilize these outputs as a product it is necessary to multiply these two voltages in a simple manner. This approximate multiplication is accomplished as hereinbefore stated by applying the signal respectively to the first and second signal grids of the pentagrid converter type tube $V_5$ in which the flow of plate current is substantially proportional to the product of the two voltages within the limited range required and for positive voltages. The voltages are introduced to the grids by resistive-capacitive coupling networks having large time constants as compared to the time constants used in the differentiating networks. The relay in the plate circuit of tube $V_5$ provides the contact closure required of the discriminator to allow an actuation of the mine circuit.

The theoretical localization is considerably reduced as the depth of submergence of the mine increases since the length of the radius factor R FIG. 7, from the mine to the ship changes more slowly as distance abeam increases at greater depths. Some form of depth compensation is thus desirable. This relationship will be apparent from FIG. 7 and the mathematical presentation hereinafter set forth. The depth compensation function, however, is obtained by the stepped attenuator of FIG. 1 at 19, 20, which changes the effective gain in the first derivative stage network 18 in definite steps. Although the structure is not shown in complete form, the attenuator may be operated by bellows structure generally indicated at 27 by the hydrostatic pressure of the water in which the mine is planted. Also it is desirable to provide some compensation for the speed of the vessel. This is obtained by means of the continuously variable attenuator 24 in one of the grid circuits of the multiplication tube. This attenuator may be ganged to the rotor shaft for the multiple cam switches of the mixer mechanism or driven from the constant speed D.C. motor utilized in the mixer drive of the mine mixer mechanism. It is connected in an arrangement providing movement of the tap of the variable resistor. This movement may be a rotary motion occurring at the time the first detectable influence to which the mine is sensitive, such for example as a magnetic "look" is presented to the mine mixer. The mixer may comprise a constant speed timing arrangement for providing electrical switching in various circuits of the mine in a predetermined time sequence. The magnetic "look" occurs as the bow of the ship enters the field of magnetic sensitivity of the mine. The greatest attenuation of the detected acoustic signal occurs at the start of rotation of the aforementioned variable resistance and is decreased according to an approximate cubic law so that the maximum sensitivity is provided for the slowest vessels. The resistance of the potentiometer requires a cubic relationship with time since speed occurs in the fall-off equation to the third power. In this manner it is possible to provide for speed variations of ships. In practice, however, partial compensation rather than complete compensation is used since the length of ships to which the mechanism is subjected is not a constant. Where the instant triggering function circuit is utilized for a combination influence mechanism "looks" such as the aforementioned magnetic field influence are received from other influence mechanisms during the passage thereover of the bow of the ship. A variable attenuator for speed is therefore utilized. For other types of mines of a character not having magnetic or pressure discriminators, the value of the speed compensation potentiometer will be set to a fixed value as determined by the expected ship traffic.

The operation of the circuit will become more apparent when taken in consideration with the mathematical presentation hereinafter set forth with the mathematical representation of a ship's sound signature. It is well known that the audio spectrum of a normal ship's sound is complex since energy components are distributed over a wide range of frequencies and amplitudes. It is therefore desirable to initially select a frequency band or bands which will yield optimum localization for the type of vessel under consideration. The localization as herein used is defined as a degree of discrimination obtained by a mechanism as a function of the distance abeam and, as plotted, is shown commonly as an athwartship amplitude fall-off curve.

Referring now to FIG. 7 there is a showing of the geometric relationship of interest for a ship passing a ground mine wherein the following designations in the mathematical analysis relate to certain of the reference characters as follows:

V = Sound pressure
R = Radial distance from the mine to the ship
K = Ship's loudness constant with the sound energy output of a ship assumed to be constant during passage.
S = On-course distance
N = Least distance of approach of ship to the mine $=\sqrt{(b^2+d^2)}$
t = Time which is assumed to be 0 at the time corresponding to the least distance of approach
c = Speed of vessel
$\alpha$ = Fall-off exponent
b = Distance abeam which is the normal distance from ship's course to a point on the surface directly over the mine.
d = Depth of mine The envelope of the sound pressure from a given ship can be represented approximately by the function $$V = \frac{K}{R^{\alpha}} = \frac{K}{(S^2 + N^2)^{\alpha/2}} = \frac{K}{(C^2t^2 + b^2 + d^2)^{\alpha/2}} \quad (1)$$

Figure 2:
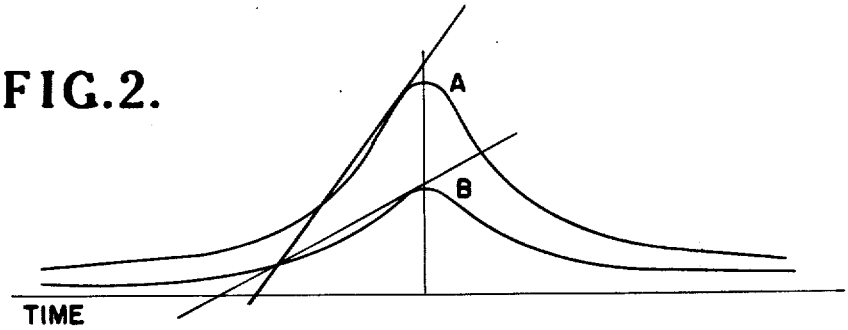
FIG. 2 is a curve showing in representative form the amplitude characteristics of the underwater acoustic signatures of two characteristic types of ships of different degrees of loudness as they pass over a mine at the same speeds.

The typical shape of the rectified signal received from a hydrophone after filtering with a band-pass filter to obtain optimum localization by suitable selection of the frequency range is shown by curves A and B of FIG. 2. The maximum amplitude of the signal, in general corresponds to the least distance of approach of the vessel to the hydrophone, or more strictly to the least distance of approach of the source of sound in the vessel to the hydrophone. From formula (1) the constant K in this equation is hereinafter designated as the ship's loudness constant and equation (1) may be written as:

$$K = VR^{\alpha} \quad (2)$$

The loudness constant can therefore be expressed as the product of the sound pressure and the distance at which the source of noise is observed to some power $\alpha$. Suitable values of the exponent, $\alpha$ required to obtain an approximate mathematical fit with experimental data by this equation yield values ranging from 0.8 to 2.2. The value of $\alpha$ varies with bottom conditions and with water depth. The choice of the frequency band utilized for optimum localization is partially dependent on the values of $\alpha$ obtained from experimental data. It has been determined by test that a satisfactory value of $\alpha$ can be approximated as unity. The ship's loudness constant K however varies greatly from ship to ship and is proportional to the total amplitude of sound produced by the ship and, consequently, varies also with the speed of the vessel. The signatures of a few ships depart from these simplifying assumptions due to the existence of several sources of sound in the vessel and for other reasons, however by proper design of the smoothing filter and choice of operating frequency band, some of the effects of these anomalies can be minimized in the discriminator design. The characteristic envelope appearance of the signals from two ships having different loudness characteristics and after passing the received signal from the hydrophone through a band-pass filter, rectifier and smoothing filter is as shown by curves A and B on FIG. 2.

The prior art methods of triggering used by certain of the existing mechanisms, in general utilize the magnitude of the envelope of the sound pressure variation as shown in FIG. 2 and require that a given minimum value of sound pressure exist for a given period of time in order to trigger the mine. However, for very slow vessels, the rate of change of the sound pressure variation is not appreciable.

From equation (1), it is apparent that the maximum value of sound pressure occurs at t = 0 or when the ship is nearest to the mine. The following equation is then used for determining the athwartship amplitude fall-off curve.

$$V_{MAX} = \frac{K}{(b^2 + d^2)^{\alpha/2}} = \frac{K}{N^{\alpha}} \quad (1a)$$

As a consequence of the above, the mine firing is dependent on K, the ship's loudness constant, and the value of the least distance of approach of the ship to the mine. Since K varies greatly from ship to ship, it is impossible to have a highly localized firing pattern with this type of triggering function. Since the value of $\alpha$ is usually about one, an inverse first power athwartship amplitude fall-off pattern is expected in general. The mathematical representation for an ideal signature is developed in the foregoing. It is possible however to derive other function from this ideal signature which may be more useful or desirable as a trigger function. The simplest of these is the rate of change of sound pressure with time.

Referring now to the signatures of two vessels shown in FIG. 2 having different rates of change as illustrated by the tangents drawn to these curves, the tangent lines represent the maximum rates of change of sound pressure for the respective signatures. These two target signatures differ because of possible variations in K, $\alpha$, C and R. Differentiating equation (1) to show the rate of change, mathematically $$\frac{DV}{dt} \quad \frac{K\,C^2 t}{(C^2t^2 + b^2 + d^2)^{\frac{\alpha}{2} + 1}} \quad (3)$$

wherein the maximum value of DV/dt of interest is that which occurs when $$S = -\frac{\sqrt{(b^2 + d^2)}}{\sqrt{(\alpha + 1)}}$$

If $\alpha$ is assumed $=1$, $$\frac{DV}{dt_{MAX}} = \frac{2Kc}{\sqrt{(27)\,(b^2 + d^2)}} \quad (4)$$

The obvious conclusions to be obtained from expression (3) are that if a voltage proportion to (DV/dt) were used to trigger the firing of the mine, the mine firing would be dependent, theoretically, on the ship's loudness constant K, the fall-off exponent $\alpha$, the speed of the vessel, and the least distance of approach. Since the ship's loudness constant K varies greatly from ship to ship and depends on the amount of sound generated, the rate of change is dependent upon the magnitude of the sound output of the vessel. Thus, it is impossible, or at least entirely unsatisfactory to secure a satisfactory localized firing pattern with either the (V) or the (DV/dt) types of triggering functions. Therefore, to make any appreciable improvement over this type of discriminator design, it is essential that a means for obtaining a triggering signal that is practically independent of the ship's loudness constant K be obtained.

The subsequent discussion is concerned with the above intermediate function of the instant triggering function. After the foregoing rectifying and filtering of the signal other characteristics are developed which are based on the rates of change with time or the logarithm of the sound pressure.

The rectified and filtered signals of the sound pressure for two vessels having values of sound pressure which differ by a factor of 2 are illustrated generally by FIG. 2. The curves A' and B' shown in FIG. 3 result from having obtained the logarithm of the curves A and B respectively as shown on FIG. 2. This operation produces a set of new curves, now having the same shape, i.e., by vertical displacement, one could be superimposed over the other. These curves are representative of vessels having the same course, speed, etc. and differing only by the amount of sound produced, or in mathematical terminology have a different value of K in equation (1).

Figure 3:
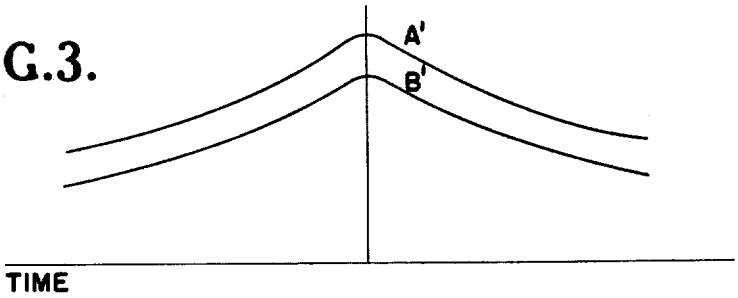
FIG. 3 is a curve showing the limitation of amplitude differences between large and small ships or ships of different degrees of loudness moving at the same speeds when the logarithm of the respective signals are compared.

FIGS. 4 and 5 show curves A'', B'' and A''', B''' respectively for the first and second time derivatives of the amplitude characteristics shown in FIG. 3. These derivates are independent of the scale factor of the original amplitude of the sound pressure and are identical as shown in representative form by the solid line curves A'', A''' and the dotted line curves B'' and B'''. Therefore, the mine firing patterns, or localization, obtained from these derived functions must also be independent of the amplitude of the sound pressure emitted by the ship. This is equivalent to stating that the magnitudes of any number of derivatives of the logarithm of the sound pressure are independent of the value of K in formulae (1).

The value of the first derivative of the logarithm is zero at the time corresponding to the least distance of approach of the ship to the mine. At this time the second derivative has a maximum value. Mathematically differentiating equation (1)

$$\frac{D\ln V}{dt} = \frac{1}{V}\,\frac{DV}{dt} = -\frac{\alpha c^2 t}{(C^2t^2 + b^2d^2)} \quad (5)$$

Differentiating again, $$\frac{D^2\ln V}{dt^2} = \alpha c^2\left[\frac{c^2t^2 - b^2 - d^2}{(c^2t^2 + b^2 + d^2)^2}\right] \quad (6)$$

One of the primary objects to be attained in the design of an acoustic discriminator is a good athwartship amplitude fall-off pattern. If the second derivative of the logarithm were ued as the triggering function, the athwartship amplitude fall-off would vary inversely as the second power of the least distance of approach as will now be shown. From equation (6) $D^2\ln V/d^2t$ has a maximum at $t=0$. Substituting $t=0$ in equation (6) one obtains for the athwartship amplitude fall-off curve $$\left[\frac{D\ln V}{dt^2}\right]\mathrm{MAX} = \frac{-\alpha c^2}{b^2 + d^2} \quad (7)$$

A comparison of the athwartship amplitude fall-off patterns represented by equations (4) and (7) shows that if the parameter K of equation (4) is replaced by the parameter C, the equations are identical except for a scale factor. The range of variation of the parameter C for mine applications is normally from about 5 knots to about 15 knots or a ratio of about 3 to 1. Since this variation in the parameter C (3:1) is considerably smaller than the variation of the parameter K (approximately 20:1) which has been replaced, equation (7) for the second derivative of the logarithm of the sound pressure variation represents a considerably improved triggering function over the rate of change type represented by equation (4) with respect to the localization obtainable. Similar conclusions can be drawn from a comparison of equations (7) and (1) for the amplitude type of triggering. The triggering function prescribed by equation (6) reaches a maximum value at a later time than the one for equation (3). This is an adverse condition since the sources of sound in a ship are usually aft the midship section and there is an unavoidable delay due to the smoothing filter in a practical discriminator design. Despite the good localization pattern obtained by the second derivative of the logarithm, firing would occur too late if it were used alone as the triggering function.

In order to obviate the difficulties as hereinbefore outlined and to further improve the localization pattern, another derived function, i.e., the product of the first and second derivatives of the logarithm is utilized in the instant invention. This function provides the most favorable overall characteristics.

Multiplying equation (5) by equation (6) one obtains the product function, P, shown as curve P on FIG. 7, which is the product of the first and second derivatives of the logarithm of the sound pressure.

$$P = \frac{D\ln V}{dt} \times \frac{D^2\ln V}{dt^2} = -\alpha c^4 t\left[\frac{c^2t^2 - b^2 - d^2}{(c^2t^2 + b^2 + d^2)^3}\right] \quad (8)$$

Differentiating and setting DP/dt=0, one obtains the quartic equation $$t^4 - \frac{8}{3}\ \frac{b^2 + d^2}{c^2}\ t^2 + \frac{(b^2 + d^2)}{3c^4}\ 2 = 0 \quad (9)$$

and solving for the time when the usable product is maximum, one obtains $$t_{PMAX} = \frac{-0.36\sqrt{b^2 + d^2}}{c} \quad (10)$$

The corresponding distance $$S_{PMAX} = ct_{PMAX} = \frac{-0.36\sqrt{b^2 + d^2}}{c}$$

is obtained by substituting the value of t in the above equation.

$$P_{MAX} = \frac{-0.22\alpha^2C^3}{(b^2 + d^2)^{3/2}}.$$

Thus it is shown that an advance in the peak value of the product function with respect to the peak of the acoustic signature occurs which is independent of speed and $\alpha$. This triggering function is illustrated on FIG. 6 of the drawings. Further equation show that the maximum value of the product varies as $$\frac{1}{N^3} = \frac{1}{(b^2 + d^2)^{3/2}},$$

hence a very good athwartship fall-off pattern is obtained. The firing point occurs either at the peak or earlier than the peak value depending on the magnitude of the product function shown.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. A system for providing an improved triggering function for firing of a mine from the acoustic signature of a ship passing thereover or in the vicinity thereto comprising means for detecting the envelope of a portion of the audio signature spectrum of the ship, means for deriving a signal corresponding to the logarithm of said detected envelope signal, means responsive to said logarithm signal for providing a signal representative of the first time derivative thereof, means for subsequently obtaining a signal simulating the second time derivative of said logarithmic signal, means for inverting the phase of said second time derivative signal, means for providing a multiplication of said first and second time derivative signals, and means responsive to said multiplied signals for actuation of a mine detonating circuit.

2. The system of claim 1 further characterized by the addition of means for amplifying the signal level of said second time derivative signal prior to application thereof to said multiplication means.

3. The system of claim 2 further including means for correlating the time period of operation of the system with the rate of travel of the ship providing the acoustic signature being detected.

4. The system of claim 1 further including means for providing compensation in the first derivative taking means thereof for the depth of submergence of the system in a body of water.

5. An acoustic mine firing system comprising means for detecting a desired portion of the audio spectrum of a ship's audible underwater signature, means for detecting the envelope of the ship's audible signature from said selected portion of the audio spectrum, means for providing a signal corresponding to the logarithm of said detected envelope, means for obtaining a signal corresponding substantially to the first derivative with respect to time of said logarithm signal, means responsive to said first derivative means for obtaining a second signal correlative to the second derivative with respect to time of said logarithm signal, and phase inverted with respect to said first derivative signal, and means including a multiplier for obtaining the product of said first and said second time derivative signals.

6. The system of claim 5 further including means for providing a phase inversion of the second time derivative signal prior to application thereof to the multiplying means.

7. In a mine detection system for mine actuation in response to a characteristic intelligence indicative of a passage of a ship over said system, the combination, of an underwater audio signal detector of a character providing an output representing the envelope of a preselected portion of the sound spectrum of a ship's audible signature, means for deriving a signal corresponding to the first derivative with respect to time of the logarithm of said signal, means for deriving a signal corresponding to the second derivative with respect to time of the logarithm of said detected envelope signal, and utilization means for providing mine actuation correlative to the product of said first time derivative signal and second time derivative.

8. A method of providing an improved triggering function for a mine circuit of a character utilizing a portion of the audio spectrum of a ship passing in the immediate vicinity thereto which comprises transducing underwater audio signal intelligence emitted from said ship into electrical signals, filtering said transduced signals to provide a desired frequency range from a portion of said audio spectrum signal, detecting the envelope of said filtered signal, subjecting the detected envelope to additional filtering of a character for obtaining a signal similating the logarithm of said envelope, thereafter obtaining a similation of the first derivative of said logarithmic signal, smoothing out irregularities in said first derivative signal, thereafter obtaining a similated second derivative signal from said first derivative signal, inverting the phase of said second derivative signal with respect to the phase of the first derivative signal, multiplying said first derivative signal by said phase inverted second derivative signal, and obtaining a triggering output signal for mine actuation which is proportional to the product of said first time derivative signal and said phase inverted second time derivative signal.

9. A method of providing actuation of a mine detection system by detecting a portion of the audible signature of a ship passing thereover, submitting the signal to the successive steps of filtering to a selective band width, rectifying to obtain a signal corresponding to the envelope of the acoustic signature, further rectifying a portion of the signal to provide a signal corresponding in character to the logarithmic thereof, additionally filtering the logarithmic signal to obtain simulation of the first time derivative thereof, altering the magnitude of said derivative signal to compensate for the depth of submergence of the mine, amplifying the thus compensated signal to increase the level thereof sufficient to overcome the loss introduced by subsequent steps, applying the amplified output signal to a signal multiplying means, deriving a signal corresponding to the second derivative of said amplified signal, phase inverting the second derivative signal and multiplying by said first derivative signal, and obtaining an output for mine firing which is proportional to the product of said first time derivative of the logarithm of the acoustic signature and the second time derivative of the logarithmic signal thereby advancing the firing triggering function with respect to the amplitude peak of the acoustic signature while rendering the said output independent of the audio amplitude of the ship's signature.

* * * * *